US009046836B2

(12) United States Patent
Miyamae

(10) Patent No.: US 9,046,836 B2
(45) Date of Patent: Jun. 2, 2015

(54) IMAGE FORMING APPARATUS FOR RESTRICTING EXCESSIVE TEMPERATURE RISE OF FIXING MEMBER

(71) Applicant: KYOCERA Document Solutions Inc., Osaka (JP)

(72) Inventor: Tsubasa Miyamae, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/159,460

(22) Filed: Jan. 21, 2014

(65) Prior Publication Data

US 2014/0205306 A1 Jul. 24, 2014

(30) Foreign Application Priority Data

Jan. 21, 2013 (JP) ..... 2013-008636

(51) Int. Cl.
*G03G 15/20* (2006.01)

(52) U.S. Cl.
CPC ..... *G03G 15/2039* (2013.01)

(58) Field of Classification Search
CPC ..... G03G 15/205; G03G 15/2078
USPC ..... 399/33, 70
See application file for complete search history.

(56) References Cited

U.S. PATENT DOCUMENTS 8,218,983 B2 * 7/2012 Takano ..... 399/33

FOREIGN PATENT DOCUMENTS

JP 2001-242740 A 9/2001
JP 2004348036 A * 12/2004

OTHER PUBLICATIONS

Machine Translation of JP 2004-348036 A obtained on Oct. 21, 2014.*

* cited by examiner

*Primary Examiner* — Gregory H Curran
(74) *Attorney, Agent, or Firm* — James W. Judge

(57) ABSTRACT

An image forming apparatus includes a fixing unit, a power supply switch, a timer unit, a backup memory, and a controller. The backup memory is configured to nonvolatilely store an accumulated time, the accumulated time being a total period of time during which a heater is energized for detection of disconnection of a temperature-detecting unit after the power supply switch is turned on. The controller is configured to: recognize temperature of a heated member based on an output from the temperature-detecting unit, control the energization of the heater, and start the energization of the heater when the power supply switch is turned on. The controller is configured to determine that a disconnection of the temperature-detecting unit has occurred if the temperature recognized based on the output from the temperature-detecting unit remains in a predetermined low-temperature zone when the accumulated time has become a predetermined detecting-execution time period.

5 Claims, 8 Drawing Sheets

IMAGE FORMING APPARATUS FOR RESTRICTING EXCESSIVE TEMPERATURE RISE OF FIXING MEMBER

CROSS-REFERENCE TO RELATED APPLICATION

This application is based upon, and claims the benefit of priority from, corresponding Japanese Patent Application No. 2013-008636 filed in the Japan Patent Office on Jan. 21, 2013, the entire contents of which are incorporated herein by reference.

BACKGROUND

Unless otherwise indicated herein, the description in this section is not prior art to the claims in this application and is not admitted to be prior art by inclusion in this section.

Generally, an image forming apparatus, which employs an electrophotographic method, such as a printer, a multi-functional peripheral, a copier, and a facsimile, includes a fixing unit for fixing a toner image by applying heat and pressure to the toner image formed on a paper sheet. The fixing unit includes a heater to heat the toner image. The fixing unit includes a sensor to detect a temperature of a fixing member, which is heated by the heater and fixes the toner image on the paper sheet. There is provided an image forming apparatus that detects disconnection of the sensor based on an output from the sensor after electric power is supplied to the heater for a certain period of time when the power supply switch is turned on. Here, if the image forming apparatus is turned off and on in a short time, electric power is repeatedly supplied to the heater for detection of disconnection, excessive temperature rise of the fixing member may occur.

One technique to avoid this excessive temperature rise of the fixing member is proposed. Specifically, there is known an image forming apparatus that includes a prohibiting unit that prohibits supplying electric power from a power source to a heating body for a predetermined period in the case where the electric power from the power supply to the heating body is cut off and then the electric power is supplied again, time length of a heating stop state, which is from the cutoff of electric power to re-supply of electric power, is equal to or less than a predetermined time length, and an abnormality detection of the heating body and/or a temperature sensor is stored in a storage unit. This configuration can prevent excessive temperature rise or similar problems of the heating body due to disconnection, contact failure, or similar causes of the temperature sensor and/or the heating body.

SUMMARY

An image forming apparatus according to an exemplary embodiment of the present disclosure includes a fixing unit, a power supply switch, a timer unit, a backup memory, and a controller. The fixing unit includes a heater configured to emit heat by energization, a heated member to be heated by the heater, and a temperature-detecting unit configured to detect a temperature of the heated member, and is configured to fix a toner image to a recording medium by heat from the heater. The power supply switch is configured to turn on and off a power source for the image forming apparatus. The timer unit is configured to count time. The backup memory is configured to nonvolatilely store an accumulated time. The accumulated time is a total period of time during which the heater is energized for detection of disconnection of the temperature-detecting unit after the power supply switch is turned on.

The controller is configured to: recognize temperature of the heated member based on an output from the temperature-detecting unit, control the energization of the heater, and start the energization of the heater when the power supply switch is turned on. The controller is configured to determine that a disconnection of the temperature-detecting unit has occurred if the temperature recognized based on the output from the temperature-detecting unit remains in a predetermined low-temperature zone when the accumulated time has become a predetermined detecting-execution time period.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 3 is a diagram for describing a problem of when the conventional image forming apparatus is repeatedly turned off and on.

FIG. 4 is a diagram for describing a problem of when the conventional image forming apparatus is repeatedly turned off and on.

FIG. 5 is a diagram for describing execution of detection of disconnection when the printer is repeatedly turned off and on.

DETAILED DESCRIPTION

Figure 1:
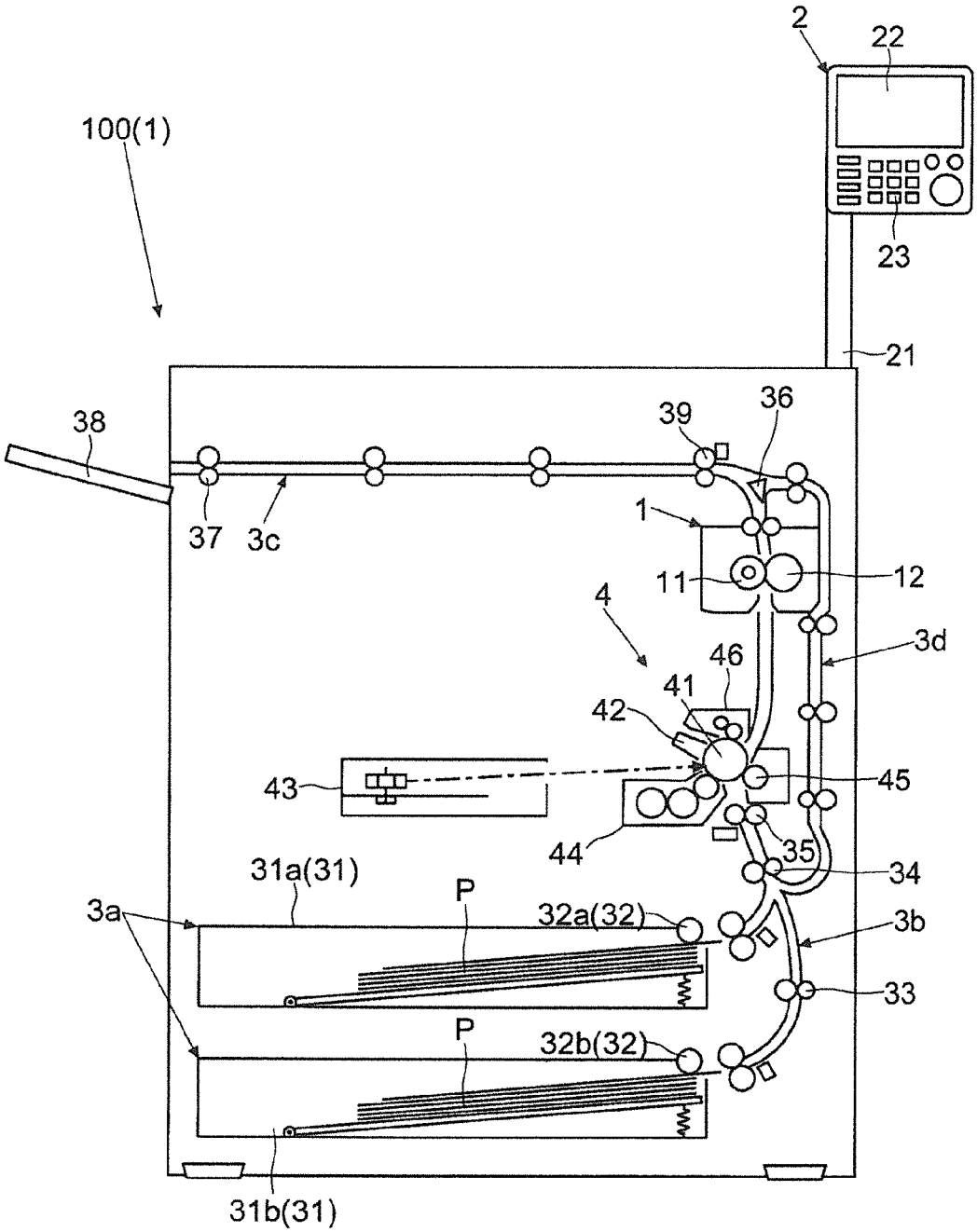
FIG. 1 illustrates a configuration of a printer according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the disclosure, as generally described herein, and illustrated in the drawings, can be arranged, substituted, combined, separated, and designed in a wide variety of different configurations, all of which are explicitly contemplated herein.

The following describes an image forming apparatus including a fixing unit 1 according to the embodiments of the disclosure with reference to FIGS. 1 to 8. The description will be given of a printer 100 as an exemplary image forming apparatus. However, each element such as the configuration and the arrangement described in each embodiment is illustrative without limiting the scope of the disclosure.

Outline of Printer 100

First, with reference to FIG. 1, the configuration of the printer 100 according to the embodiment will be described. FIG. 1 illustrates the configuration of the printer 100.

As illustrated in FIG. 1, the printer 100 according to the embodiment includes an operation panel 2 attached to a side portion. The printer 100 includes a paper sheet feeder 3*a*, a first conveying unit 3*b*, an image forming unit 4, a fixing unit 1, and a second conveying unit 3*c*.

First, as illustrated in FIG. 1, the printer 100 includes the operation panel 2. The operation panel 2 corresponds to a notification unit. The operation panel 2 is located at a tip of an arm 21 located on the top right side of the printer 100. The operation panel 2 includes a display unit 22 to display states of the printer 100, various messages, and setting windows. Upon detection of an error of a temperature sensor 7 (details will be described later), the display unit 22 notifies the error of the temperature sensor 7. The operation panel 2 also includes a plurality of keys 23 for setting and input.

As illustrated in FIG. 1, the printer 100 includes the paper sheet feeder 3*a* at the lower portion of the inside. The paper sheet feeder 3*a* includes a plurality of cassettes 31. In FIG. 1, reference numeral 31*a* denotes the upper cassette while reference numeral 31*b* denotes the lower cassette. Each cassette 31 houses a plurality of paper sheets P as recording medium. Each cassette 31 is provided with a paper feed roller 32 rotated by a driving mechanism (not shown) such as a motor and a gear. In FIG. 1, reference numeral 32*a* denotes the upper paper feed roller while reference numeral 32*b* denotes the lower paper feed roller. The paper feed roller 32 rotates to send out a paper sheet P to the first conveying unit 3*b*.

The first conveying unit 3*b* feeds the paper sheet P inside of the printer 100. The first conveying unit 3*b* feeds the paper sheet P approximately vertical along the right-side surface of the main body of the printer 100. The first conveying unit 3*b* guides the paper sheet P supplied from the paper sheet feeder 3*a* to the image forming unit 4. The first conveying unit 3*b* includes a resist roller pair 35. The registration roller pair 35 keeps the paper sheet P, which is conveyed from conveyance roller pairs 33 and 34, waiting in front of the image forming unit 4 and sends out the paper sheet P to the image forming unit 4 in accordance with timing of formation of a toner image.

The image forming unit 4 forms a toner image based on image data of an image to be formed and transfers the formed toner image onto the paper sheet P. Specifically, the image forming unit 4 includes a photoreceptor drum 41, a charging unit 42, an exposing unit 43, a developing unit 44, a transfer roller 45, and a cleaning unit 46, which are located around the photoreceptor drum 41.

The photoreceptor drum 41 can bear the toner image on its peripheral surface and rotates at a predetermined process speed. The charging unit 42 charges the photoreceptor drum 41 at a constant electric potential. The exposing unit 43 performs scanning and exposure on the charged photoreceptor drum 41 based on image data, on which an image processing is performed, through a controller 5. The scanning and exposure is performed by a laser beam illustrated by alternate long and short dash line, thereby forming an electrostatic latent image on the surface of the photoreceptor drum 41.

A developing unit 44 supplies the photoreceptor drum 41 with a toner and develops the electrostatic latent image formed on the peripheral surface of the photoreceptor drum 41. The cleaning unit 46 cleans the photoreceptor drum 41. The transfer roller 45 is brought into pressure contact with the photoreceptor drum 41. The registration roller pair 35 sends the paper sheet P into the nip between the photoreceptor drum 41 and the transfer roller 45 so as to transfer the formed toner image to a predetermined position on the paper sheet P. Then, a predetermined voltage for transfer is applied to the transfer roller 45. Thus, the toner image is transferred to the paper sheet P.

The fixing unit 1 is located downstream with respect to the image forming unit 4 in the conveying direction of the paper sheet P. The fixing unit 1 applies heat and pressure on the toner image transferred on the paper sheet P to fix the toner image on the paper sheet P. The fixing unit 1 includes a heating roller 11, which incorporates a heater 6, and a pressure roller 12. The heating roller 11 corresponds to a heated member. The pressure roller 12 is brought into pressure contact with the heating roller 11. The paper sheet P to which the toner image has been transferred is heated and pressurized when passing through the nip between the heating roller 11 and the pressure roller 12. As a result, the toner image is fixed on the paper sheet P. The fixed paper sheet P is fed to the second conveying unit 3*c* located above the fixing unit 1.

The paper sheet P discharged from the fixing unit 1 is conveyed through the second conveying unit 3*c* extending approximately horizontal from a branch unit 36 to the left-side surface of the printer 100. The paper sheet P to which the toner image has been fixed is discharged to a discharge tray 38 located outside the upper portion of the left-side surface of the printer 100 using a discharge roller pair 37. In duplex printing, a conveyance roller pair 39 of the second conveying unit 3*c* once sends out the paper sheet P, which is discharged from the fixing unit 1, from the branch unit 36 to the discharge tray 38 direction. Subsequently, the conveyance roller pair 39 switches the conveying direction back toward the right-side surface direction of the printer 100. Then, the paper sheet P passes through the branch unit 36 and is sent downward through a double-side conveying unit 3*d* and sent to upstream of the registration roller pair 35 through the first conveying unit 3*b* again.

Hardware Configuration of Printer 100

Figure 2:
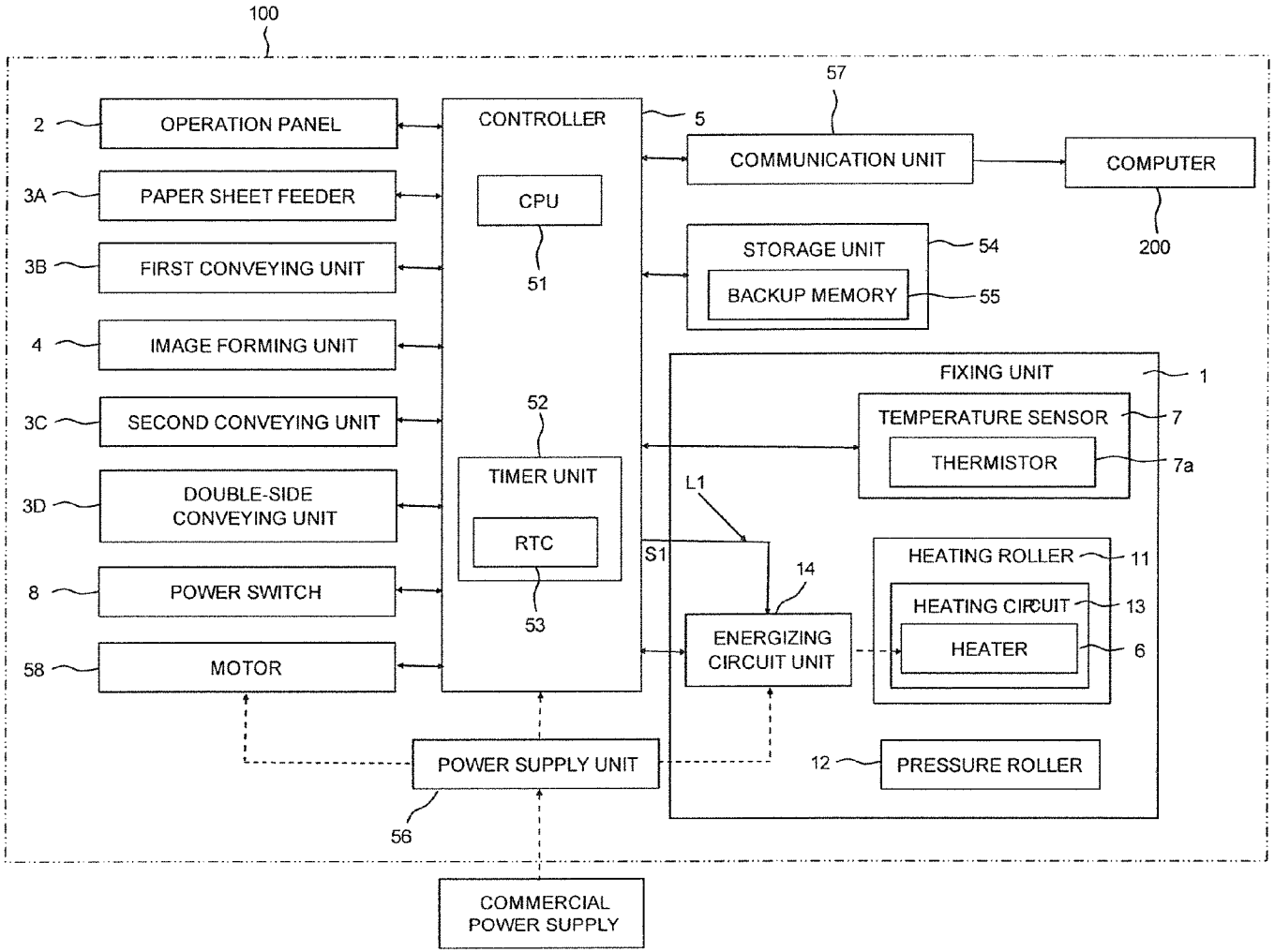
FIG. 2 illustrates a hardware configuration of the printer according to the embodiment.

Next, based on FIG. 2, the hardware configuration of the printer 100 according to the embodiment will be described. FIG. 2 illustrates the hardware configuration of the printer 100.

First, as illustrated in FIG. 2, the printer 100 according to the embodiment includes the controller 5 that controls the operation of the printer 100 or controls the operation of the fixing unit 1 such as on/off control of energization for the heater 6. The controller 5 includes a CPU 51 as a central processing unit for the controller 5. The controller 5 includes a timer unit 52 that counts time.

The timer unit 52 counts time needed for controlling the printer 100. The timer unit 52 includes an RTC 53 (Real Time Clock) chip and can count time at a specific time point. The RTC 53 may be backed up with a storage battery to be operated as a clock even if electric power supply to the printer 100 is all cutoff The printer 100 includes a storage unit 54 that includes storage devices of a non-volatile memory such as a Read Only Memory (ROM), a flash ROM, and a Hard Disk Drive (HDD), in combination with a volatile memory such as a Random Access Memory (RAM). The storage unit 54 stores a program and data used for various controls by the controller 5. The controller 5 reads required data and program from the storage unit 54 and controls the operation of the printer 100. Specifically, the storage unit 54 stores program and data for energization control of the heater 6 to warm the fixing unit 1 (heating roller 11) to a temperature appropriate for fixation (fixing control temperature) and maintain the fixing unit 1 (heating roller 11) at the fixing control temperature, and a program and data for prevention of excessive temperature rise of the heating roller 11.

The storage unit 54 includes a backup memory 55 that nonvolatilely stores time when the printer 100 is turned on and when the energization of the heater 6 of the fixing unit 1 is started. If the controller 5 detects a failure and/or an error, the backup memory 55 in the storage unit 54 stores logs indicating the detected failure, error contents, and the date and time of the occurrence and detection (log data).

The controller 5 is communicatively connected to the paper sheet feeder 3*a*, the first conveying unit 3*b*, the image forming unit 4, the fixing unit 1, a power supply unit 56, and similar units, and controls the operation of each connected unit.

A communication unit 57 as a communication interface is connected to the controller 5. The communication unit 57 is communicatively connected to a computer 200 such as a personal computer and a server via a network and/or a cable. The communication unit 57 receives printing data including image data and print setting data from the computer 200. The controller 5 controls, for example, sheet feed, conveyance of a paper sheet, formation of a toner image, and fixation based on printing data and prints on the paper sheet P.

The printer 100 according to the embodiment includes one or a plurality of motors 58. The motors 58 rotate various rotators such as the heating roller 11, the photoreceptor drum 41, the paper feed rollers 32, and roller pairs of the respective conveying units. The controller 5 drives the one or plurality of the motors 58 during printing to perform sheet feed, conveyance of a paper sheet, formation of a toner image, transfer, and fixation, and similar process.

The controller 5 also controls the fixing unit 1. As illustrated in FIG. 2, the fixing unit 1 includes a heating circuit 13 that includes the heater 6 located inside of the heating roller 11. An energizing circuit unit 14, which switches on or off the energization of the heater 6, is connected to the heating circuit 13. The energizing circuit unit 14 includes a switching element such as a semiconductor switch that switches between energization and cutoff of the heater 6.

A heater control signal line L1 from the CPU 51 of the controller 5 is connected to the energizing circuit unit 14. The CPU 51 inputs a signal (heater driving control signal S1) to instruct on/off control of the energization of the heater 6 to the energizing circuit unit 14 through the heater control signal line L1. The energization of the heater 6 is turned on or off according to the heater driving control signal S1, which is transmitted through the heater control signal line L1.

The printer 100 internally includes the temperature sensor 7 located in the fixing unit 1. The temperature sensor 7 is configured to detect the temperature of the heating roller 11. The temperature sensor 7 corresponds to a temperature-detecting unit. The output voltage value of the temperature sensor 7 is input to the controller 5. The temperature sensor 7 includes a thermistor 7*a*. The thermistor 7*a* contacts (or may be not in contact with) the heating roller 11. Since the thermistor 7*a* changes its resistance value according to the temperature, the output voltage value of the temperature sensor 7 is changed depending on the temperature of the heating roller 11. The CPU 51 of the controller 5 performs A/D conversion of the output voltage value of the temperature sensor 7 and detects the temperature of the heating roller 11 by magnitude of the output voltage value. An A/D converter to convert the output voltage value of the temperature sensor 7 may be separately included in the controller 5

The storage unit 54 stores a data table showing the correspondence relationship between the magnitude of the output voltage value of the temperature sensor 7 and the temperature of the heating roller 11. The controller 5 refers to the data table in the storage unit 54 and recognizes the temperature of the heating roller 11 based on the output voltage value of the temperature sensor 7.

The controller 5 recognizes the current temperature of the heating roller 11 and controls the energization of the heater 6 with the heater driving control signal S1 after the main power supply is turned on, except when the operation transitions to a power-saving mode and the temperature of the fixing unit 1 is maintained low. Thus, this temperature control is performed so as to maintain the temperature of the heating roller 11 at the fixing control temperature. "Fixing control temperature" is a temperature of the heating roller 11 attempted to be maintained during printing and appropriate for fixing the toner image. Considering toner fusing properties, the materials of the heating roller 11 and the pressure roller 12, and similar factors, a temperature appropriate for fixing the toner image is set as the fixing control temperature to each image forming apparatus model by, for example, experiments, in advance. The fixing control temperature is set preferably approximately 150° C. to approximately 200° C., and more preferably approximately 170° C. to approximately 200° C.

When the temperature of the heating roller 11 is lower than the fixing control temperature when the main power source is turned on, the controller 5 causes the energizing circuit unit 14 to energize the heater 6. Thus, the temperature of the heating roller 11 is increased. Subsequently, when the controller 5 detects that the temperature of the heating roller 11 becomes higher than the fixing control temperature based on the output voltage value of the temperature sensor 7, the controller 5 instructs the energizing circuit unit 14 to turn off the energization of the heater 6. Subsequently, when the controller 5 detects that the temperature of the heating roller 11 becomes lower than the fixing control temperature, the controller 5 instructs the energizing circuit unit 14 to turn on the energization of the heater 6. Thus, in the control for maintaining the fixing control temperature, the controller 5 causes the energizing circuit unit 14 to repeatedly turn on/off the energization of the heater 6.

The printer 100 internally includes the power supply unit 56. The power supply unit 56 receives electric power from a commercial power supply. The power supply unit 56 generates a voltage required for each part located in the printer 100 such as the operation panel 2, the paper sheet feeder 3*a*, the first conveying unit 3*b*, the image forming unit 4, the fixing unit 1, the second conveying unit 3*c*, the double-side conveying unit 3*d*, the controller 5, the storage unit 54, and the communication unit 57 to operate. To generate required voltages, the power supply unit 56 includes, for example, a rectifier circuit, a smoothing circuit, a step up circuit, and a step down circuit. The power supply unit 56 also generates a voltage for driving a motor to rotate rotators that rotate for conveying a paper sheet and forming a toner image such as a roller, and supplies the motor with the generated voltage.

Turning On and Off of Power Supply Unit of Printer 100

Next, with reference to FIG. 2, processes in association with switching on and off of the printer 100 according to the embodiment will be described.

When a power supply cord (not shown) of the printer 100 is connected to a commercial power supply via an electric outlet, as shown by dashed lines in FIG. 2, electric power from the commercial power supply is input to the power supply unit 56. Simply connected the power supply cord of the printer 100 to the electric outlet, the power supply of the printer 100 remains off.

Here, even in a state where the printer 100 is turned off, electric power is supplied to the controller 5. In a state where the printer 100 is turned off, a part of the controller 5 and a part of the CPU 51 operates in a power-saving state. The controller 5 monitors whether the printer 100 is turned on with a power supply switch 8.

The printer 100 according to the embodiment includes the power supply switch 8 to turn on and off the printer 100. In other words, the user can turn on the printer 100 with the power supply switch 8 to start the printer 100 for use. Alternatively, the user can turn off the printer 100 to disable the printer 100.

The controller 5 starts upon turn-on by the operation with the power supply switch 8. The controller 5 makes the power supply unit 56 to supply each part of the printer 100 such as the operation panel 2, the paper sheet feeder 3*a*, the first conveying unit 3*b*, the image forming unit 4, the fixing unit 1, the second conveying unit 3*c*, the double-side conveying unit 3*d*, the controller 5, the storage unit 54, and the communication unit 57 with electric power. The controller 5 reads a program and data for warm-up to cause the printer 100 to be usable. The controller 5 makes each part of the printer 100 to perform a warm-up process. Similarly, the controller 5 causes the fixing unit 1 to perform the warm-up process while rotating the heating roller 11 and the pressure roller 12. During the warm-up process, the temperature of the heating roller 11 reaches the fixing control temperature.

Here, the printer 100 according to the embodiment employs the thermistor 7*a* as the temperature sensor 7. The temperature sensor 7 has a large amount of change in the output voltage value with respect to an amount of temperature change in a temperature zone such as 150 to 200° C. In other words, the thermistor 7*a* that features high sensitivity in a predetermined temperature zone including the fixing control temperature is employed. Therefore, there may not be significant difference in the output voltage value of the temperature sensor 7 between the cases where the temperature of the heating roller 11 is approximately 0° C., approximately 10° C., and approximately 20° C. In the following description, among temperatures detected by the controller 5 based on an output from the temperature sensor 7, a low-temperature region where the output voltage value of the temperature sensor 7 does not significantly change even if the temperature of the heating roller 11 changes and a difference from a temperature detected during disconnection is in a predetermined temperature is referred to as a "low-temperature zone." What sort of range of output from the temperature sensor 7 will be treated as the range for the low-temperature zone is preliminary determined considering the properties of the thermistor 7*a*.

Specifically, a voltage applied to the temperature sensor 7 is approximately several volts. On the other hand, in the case where an NTC thermistor is employed as the temperature sensor 7, since the resistance value is high while the temperature is low, this low temperature makes it difficult to yield the difference of the output voltage value of the temperature sensor 7. Therefore, in the low-temperature region, a voltage input from the temperature sensor 7 to the controller 5 is almost constant value like almost minimum value or almost maximum value in a range of possible output value of the temperature sensor 7.

On the other hand, in case of disconnection at the wiring regarding the temperature sensor 7, a voltage input to the controller 5 is almost constant value like almost minimum value or almost maximum value in a range of possible output value of the temperature sensor 7. In the printer 100 according to the embodiment, the output voltage value of the temperature sensor 7 during disconnection is almost the same as the output voltage value when the temperature detected based on the output from the temperature sensor 7 is in the low-temperature zone. In other words, since the temperature sensor 7 includes the thermistor 7*a*, the output voltage value of the temperature sensor 7 during disconnection is closer to the output voltage value when the temperature detected based on the temperature sensor 7 is equal to or less than the low-temperature zone than the output voltage value higher than the low-temperature zone, and is almost the same.

Accordingly, for detection of disconnection, the heating roller 11 needs to be warmed up to the temperature where the output value of the temperature sensor 7 yields a distinct difference from the output value during disconnection, for example, the heating roller 11 is heated to equal to or more than 50° C. Therefore, at turning on the power supply switch 8, the controller 5 detects the temperature of the heating roller 11 based on the output from the temperature sensor 7. In the case where the detected temperature is preliminarily determined as a temperature in the low-temperature zone and the difference between the output value of the temperature sensor 7 and the output value during disconnection stays in the predetermined value and therefore whether disconnection has occurred or not cannot be accurately determined, the controller 5 causes the energizing circuit unit 14 to energize the heater 6 for detection of disconnection. When the controller 5 can determine there is no disconnection, according to, for example, continuation of the energization of the heater 6, the controller 5 heats the heating roller 11 until the temperature of the heating roller 11 reaches the fixing control temperature.

Next, the case where the printer 100 is turned off by the operation with the power supply switch 8 will be described. Upon turn-off of the printer 100, the controller 5 causes the power supply unit 56 to stop supplying each part of the printer 100 such as the operation panel 2, the paper sheet feeder 3*a*, the first conveying unit 3*b*, the image forming unit 4, the fixing unit 1, the second conveying unit 3*c*, the double-side conveying unit 3*d*, the controller 5, the storage unit 54, and the communication unit 57 with electric power. Therefore, the power supply for the printer 100 is shut off. To cause the printer 100 to be usable, the user operates the power supply switch 8 to turn on the printer 100.

Repeating Power-Off and -On of Power Supply Switch 8

Figure 3:
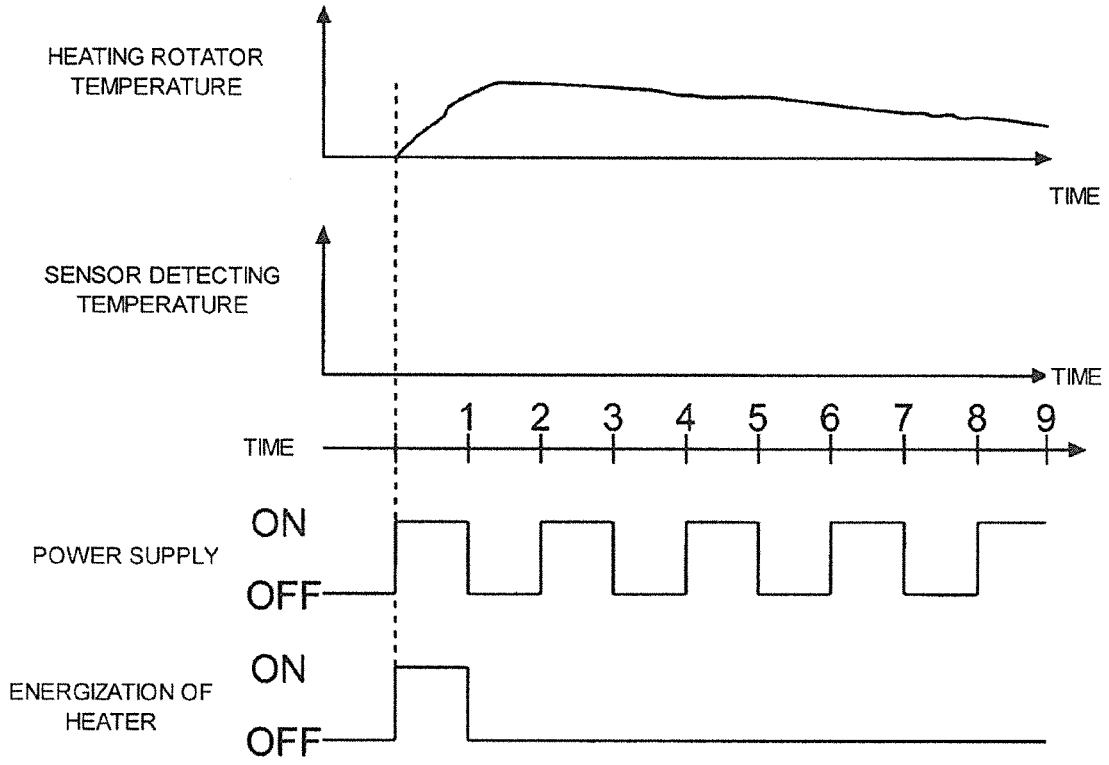
Figure 4:
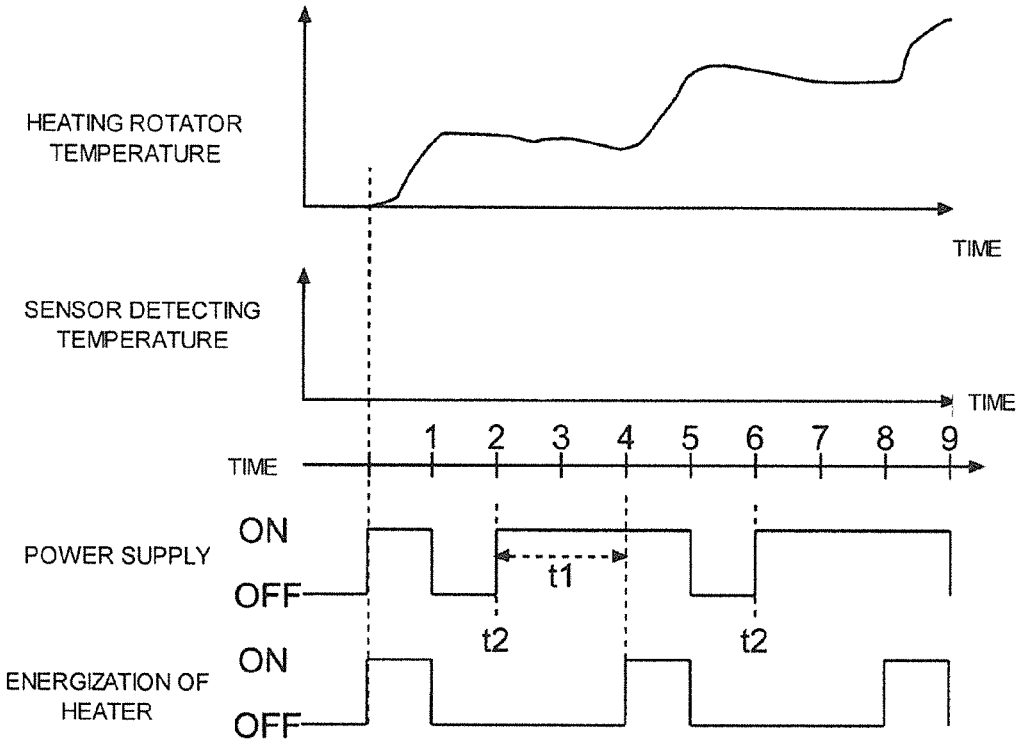

Next, using FIG. 3 and FIG. 4, the case where a power supply switch of a conventional image forming apparatus, which prints by forming a toner image, is repeatedly turned off and on will be described. FIG. 3 and FIG. 4 are explanatory views illustrating problems occurred when the power supply switch of the conventional image forming apparatus is repeatedly turned off and on.

First, the graphs and the timing charts illustrated in FIG. 3 and FIG. 4 will be described. The graphs of "Heating Rotator Temperature" in FIG. 3 and FIG. 4 illustrate transition of the temperature of a heating rotator such as the roller in the image forming apparatus with respect to time. The graphs of "Sensor Detecting Temperature" in FIG. 3 and FIG. 4 illustrate transition of the temperature detected based on an output from a temperature detecting sensor of the heating rotator in the image forming apparatus. Here, FIG. 3 and FIG. 4 illustrate transition of a detected temperature using the sensor in a disconnection state. Specifically, in FIG. 3 and FIG. 4, since the sensor is in a disconnection state, the detected temperature is constant at 0° C.

The "Time" scale indicates time passed after turning on the power supply switch. The unit is a second. The timing chart of "Power Supply" indicates timing when the power supply switch is turned on and off. In FIG. 3 and FIG. 4, a turn-on state is indicated as High and a turn-off state is indicated as Low. The timing chart of "Energization of Heater" indicates timing of energization of the heater after the power supply switch is turned on. In FIG. 3 and FIG. 4, a state where the heater is energized is indicated as High and a state where the energization of the heater is stopped is indicated as Low.

Conventionally, after turning on the power supply switch, the heater is energized for a certain period of time to detect disconnection of the temperature detecting sensor. In the case where the power supply switch is turned off before completing the energization for detection of disconnection for the certain period of time without detection of disconnection performed and the power supply switch is turned on again, the energization for detection of disconnection is started from the beginning for the certain period of time. Repeating the energization of the heater for detection of disconnection by repeatedly turning off and on the power supply switch may cause excessive temperature rise of a member in the fixing unit such as a heating rotator. In particular, in the case where disconnection occurs at the temperature detecting sensor, since the temperature detected based on the output from the temperature detecting sensor is almost constant low temperature such as 0° C., the heater is energized for detection of disconnection every repeat of turning off and on the power supply switch.

Therefore, turn-off of the power supply switch before completion of detection of sensor disconnection since turn-on of the power supply switch may be nonvolatilely stored conventionally. In other words, the fact that the power supply switch is turned-off and -on in a short interval of approximately 1 to several seconds may be stored. If a period from turn-off to turn-on is shorter than a predetermined period, start of the energization of the heater is controlled to be delayed than usual by a predetermined waiting time t1.

FIG. 3 illustrates a case where the power supply switch is repeatedly turned on and off per second. FIG. 3 illustrates an example where even if the conventional image forming apparatus is repeatedly turned off and on, the energization of the heater for detection of disconnection is not repeated. Thus, even with the related art, in the case where the turn-off/on intervals of the power supply switch is shorter than the predetermined waiting time t1 as illustrated in FIG. 3, the energization of the heater is limited to the time of turn-on performed at first time after the first turn-off. In the example of FIG. 3, the predetermined waiting time t1 exceeds 1 second.

Meanwhile, FIG. 4 illustrates an example where the energization of the heater for detection of disconnection is repeated when the image forming apparatus is repeatedly turned off and on even if the energization of the heater is delayed by the predetermined waiting time t1. As illustrated in FIG. 4, even if the energization of the heater for detection of disconnection is delayed when the switch off-on interval is short as conventionally done, the temperature of the fixing member may be excessively increased.

Specifically, in the example of FIG. 4, the predetermined waiting time t1 is set to two seconds. In other words, even if turned off and on, the energization of the heater is not started until two seconds has been passed after turn-on. Then, after elapse of two seconds after turn-on of the power supply switch again, which is the waiting time t1, the energization of the heater for detection of disconnection is started. However, if the start of the energization of the heater is delayed by the predetermined waiting time t1, this gives rise to a problem where time from turn-on of the power supply switch to completion of warm-up is lengthened.

FIG. 4 illustrates an example where the energization of the heater for detection of disconnection is performed for two seconds and the detection of disconnection is performed after the energization of the heater has continued for two seconds. With the conventional image forming apparatus, the seconds for the energization of the heater required for detection of disconnection depends on various factors such as a rate of temperature rise by the heater and a temperature detecting sensor used. The period of the energization of the heater possibly exceeds 2 second such as three to four seconds.

If the image forming apparatus is turned off before elapse of two seconds from a start of the energization of the heater, detection of disconnection is not performed. In this case, even if the sensor is disconnected, the user cannot be informed. If the power supply switch is turned on again like at the time point t2 illustrated in FIG. 4, since a temperature detected by using the temperature detecting sensor is low in case of disconnection, the energization of the heater for detection of disconnection is started from the beginning.

Thus, with the conventional image forming apparatus, even if the waiting time t1 is provided, after the power supply switch is turned on and the waiting time t1 is elapsed, if the power supply switch is turned off after the start of the energization of the heater for detection of disconnection and before execution of detection of disconnection, whether the power to the temperature detecting sensor is disconnected is not determined. When the power supply switch is turned on again, the temperature of a member in the fixing unit may be excessively raised (see FIG. 4). Therefore, with the printer 100 according to the embodiment, the detection of disconnection is performed based on accumulated time T1, which is accumulated time of the energization of the heater 6. Recently, employing a material that is difficult to cool down for power saving may causes reduced decrease in the temperature of the fixing member even if start of the energization is delayed. In this case, the time to completion of warm-up is further lengthened.

Disconnection Detection of Temperature Sensor 7 Based on Accumulated Time T1

Figure 5:
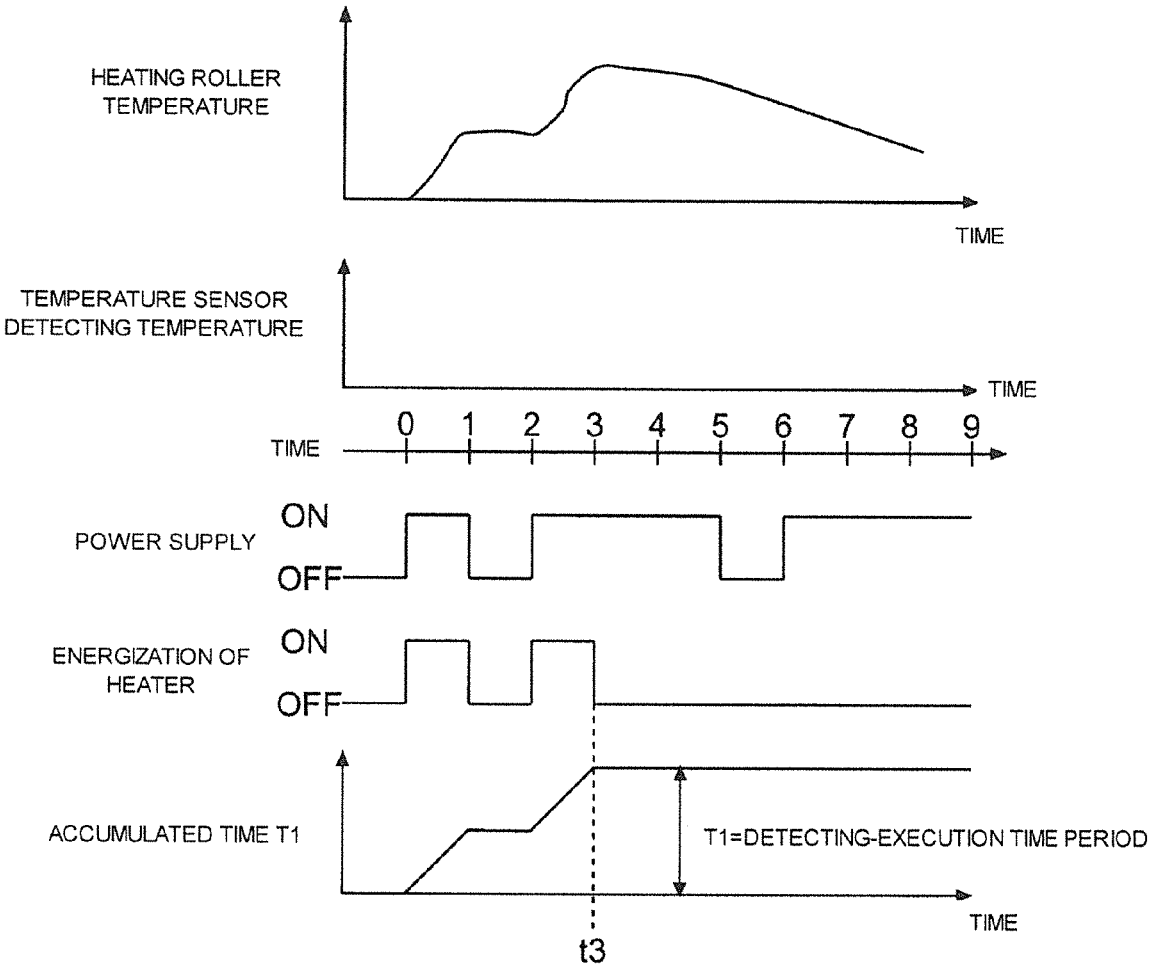
Figure 6:
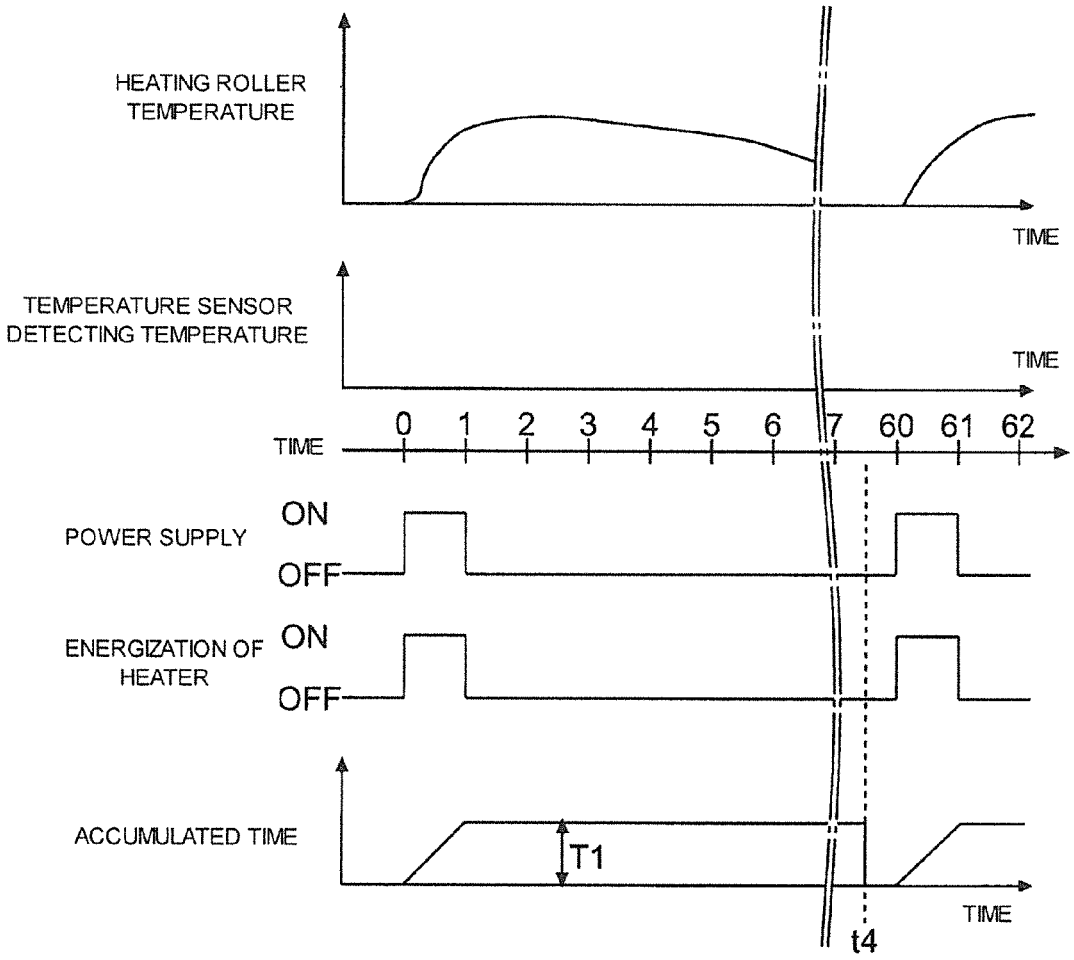
FIG. 6 is a diagram for describing a reset of accumulated time.

Next, based on FIG. 5 and FIG. 6, how detection of disconnection of the temperature sensor 7 is performed based on the accumulated time T1 related to the printer 100 according to the embodiment will be described. FIG. 5 describes detection of disconnection of when the power supply switch 8 of the printer 100 is repeatedly turned off and on. FIG. 6 describes reset of the accumulated time T1.

The graphs and the timing charts in FIG. 5 and FIG. 6 will be described. The "Heating Rotator Temperature" graphs in FIG. 5 and FIG. 6 illustrate transition of the temperature of the heating roller 11 with respect to time. The "Temperature Sensor Detecting Temperature" graphs in FIG. 5 and FIG. 6 illustrate transition of the temperature detected based on an output from the temperature sensor 7 in the fixing unit 1. Here, FIG. 5 and FIG. 6 illustrate transition of the detected temperature using the temperature sensor 7 in the disconnection state. Specifically, since the temperature sensor 7 is in the disconnection state in FIG. 5 and FIG. 6, FIG. 5 and FIG. 6 illustrate that the detected temperature is constant at 0° C.

The "Time" scale indicates time passed after turning on the power supply switch 8. The unit is a second. The "Power Supply" timing chart indicates timing when the printer 100 is turned on and off with the power supply switch 8. In FIG. 5 and FIG. 6, a turn-on state is indicated as High and a turn-off state is indicated as Low. The timing chart of "Energization of Heater" indicates timing of the energization of the heater 6 after the power supply switch 8 is turned on. In FIG. 5 and FIG. 6, a state where the heater 6 is energized is indicated as High and a state where the energization of the heater 6 is stopped is indicated as Low. Different from the example illustrated in FIG. 5 and FIG. 6, the energization of the heater 6 may be started delayed from the turn-on of the power supply switch 8.

The "Accumulated Time T1" graphs illustrate changes in the accumulated time T1, which is the total of energized time of the heater 6 for detection of disconnection, with respect to time.

With the printer 100 according to the embodiment, the controller 5 nonvolatilely stores a first actual time and a second actual time in the backup memory 55. The first actual time is turn-on time of the power supply switch 8. The second actual time is start time of the energization of the heater 6 for detection of disconnection. The timer unit 52 includes a RTC 53. Accordingly, the controller 5 can obtain and detect the first actual time, which is turn-on time of the power supply switch 8, and the second actual time, which is start time of the energization of the heater 6, based on the RTC 53.

The controller 5 counts the accumulated time T1 based on the first actual time and the second actual time stored in the backup memory 55. The controller 5 also nonvolatilely stores the counted accumulated time T1 in the backup memory 55. Then, the controller 5 performs detection of disconnection when the accumulated time T1 of the energization of the heater 6 for detection of disconnection becomes a predetermined detecting-execution time period.

FIG. 5 will be described. FIG. 5 illustrates an example of the detecting-execution time period being two seconds. Even if the power supply switch 8 is repeatedly turned off and on, the controller 5 determines whether a disconnection occurs at the temperature sensor 7 or not at the time point of the energization of the heater 6 for detection of disconnection being two seconds in total. Specifically, at the time point of t3 in FIG. 5, the determination whether disconnection occurred or not is made.

The printer 100 according to the embodiment performs detection of disconnection when the accumulated time T1 becomes the detecting-execution time period. Therefore, with the printer 100 according to the embodiment, the waiting time t1 needs not to be provided as conventionally done for the case where the image forming apparatus is turned off and on in a short time. In other words, with the printer 100 according to the embodiment, when the printer 100 is turned on using the power supply switch 8, the controller 5 starts the energization of the heater 6 at fixed timing irrespective of interval from the time when the printer 100 is turned off until the time when the printer 100 is turned on again. Accordingly, use of the technique according to the embodiment shortens time from turn-on to completion of warm-up.

Herein, in some cases the period of time from the turning off to the turning on of the power supply switch 8 next may be long enough to sufficiently cool the heating roller 11. Therefore, with the printer 100 according to the embodiment, when the elapsed time from the previous second actual time, which is the start time of the energization of the heater 6 for detection of disconnection, to the first actual time, which is turn-on time of the power supply switch 8 of the current turn-on state exceeds the predetermined stop duration, the controller 5 resets the accumulated time T1 in the backup memory 55. In other words, when certain conditions are met, the controller 5 sets the accumulated time T1 zero. The second actual time may be time at the time point of the previous turn-off of the power supply switch 8. In this case, the backup memory 55 nonvolatilely stores time when the printer 100 is turned off by the operation with the power supply switch 8 as the second actual time.

As illustrated in FIG. 6, with the printer 100 according to the embodiment, when time passed without energizing the heater 6 (turn-off time of the power supply switch 8) after the heater 6 is energized at previous time and before the detection of disconnection is performed exceeds the stop duration, the controller 5 resets the accumulated time T1 in the backup memory 55. FIG. 6 illustrates an example of resetting the accumulated time T1 at time point t4 of 60 seconds. The stop duration can be determined considering the heat dissipation characteristics and the temperature rising property of the heating roller 11.

Flow of Warm-Up Process

Figure 7:
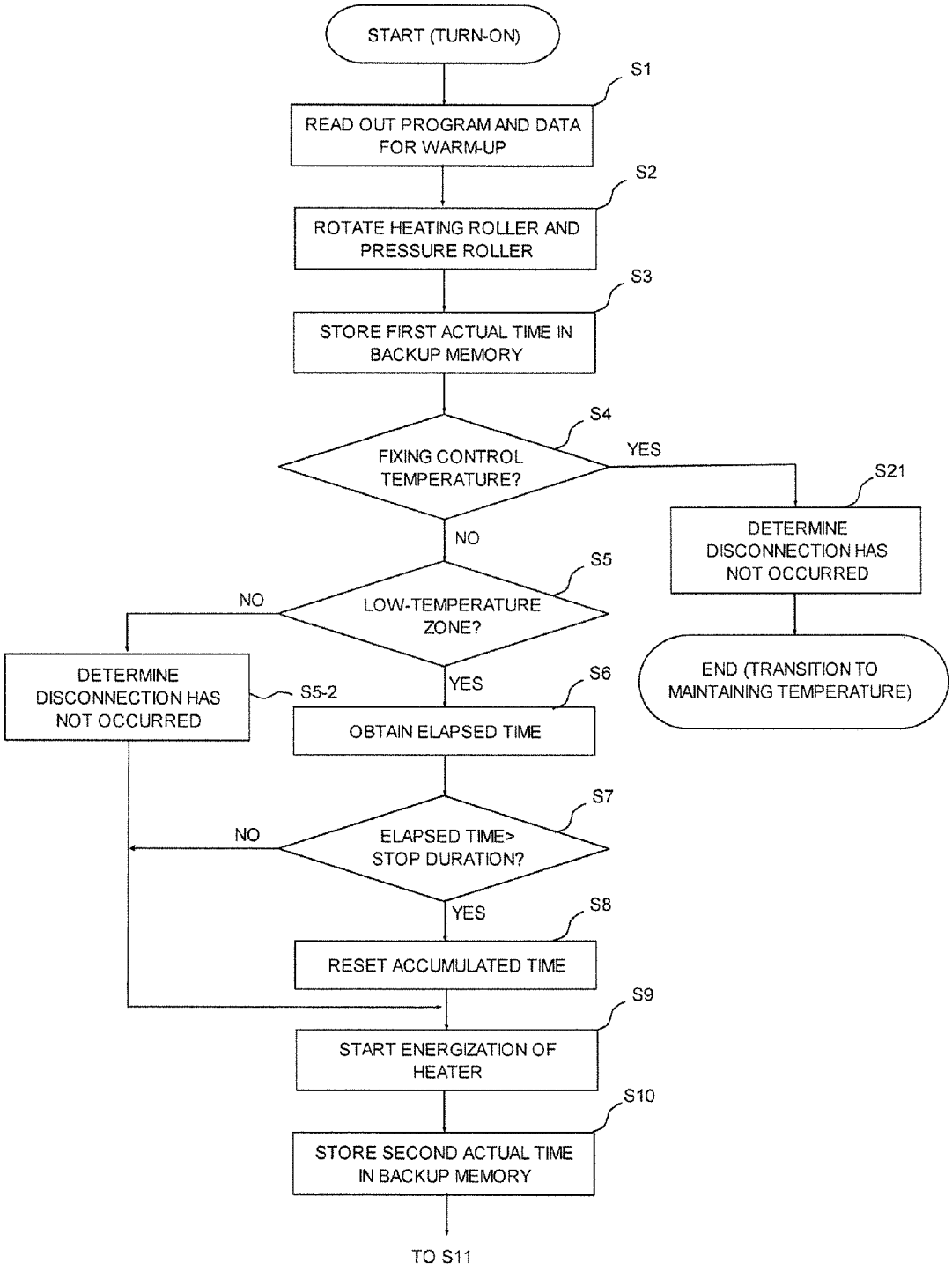
FIG. 7 is a flowchart representing a flow of a process for warm-up in a fixing unit.
Figure 8:
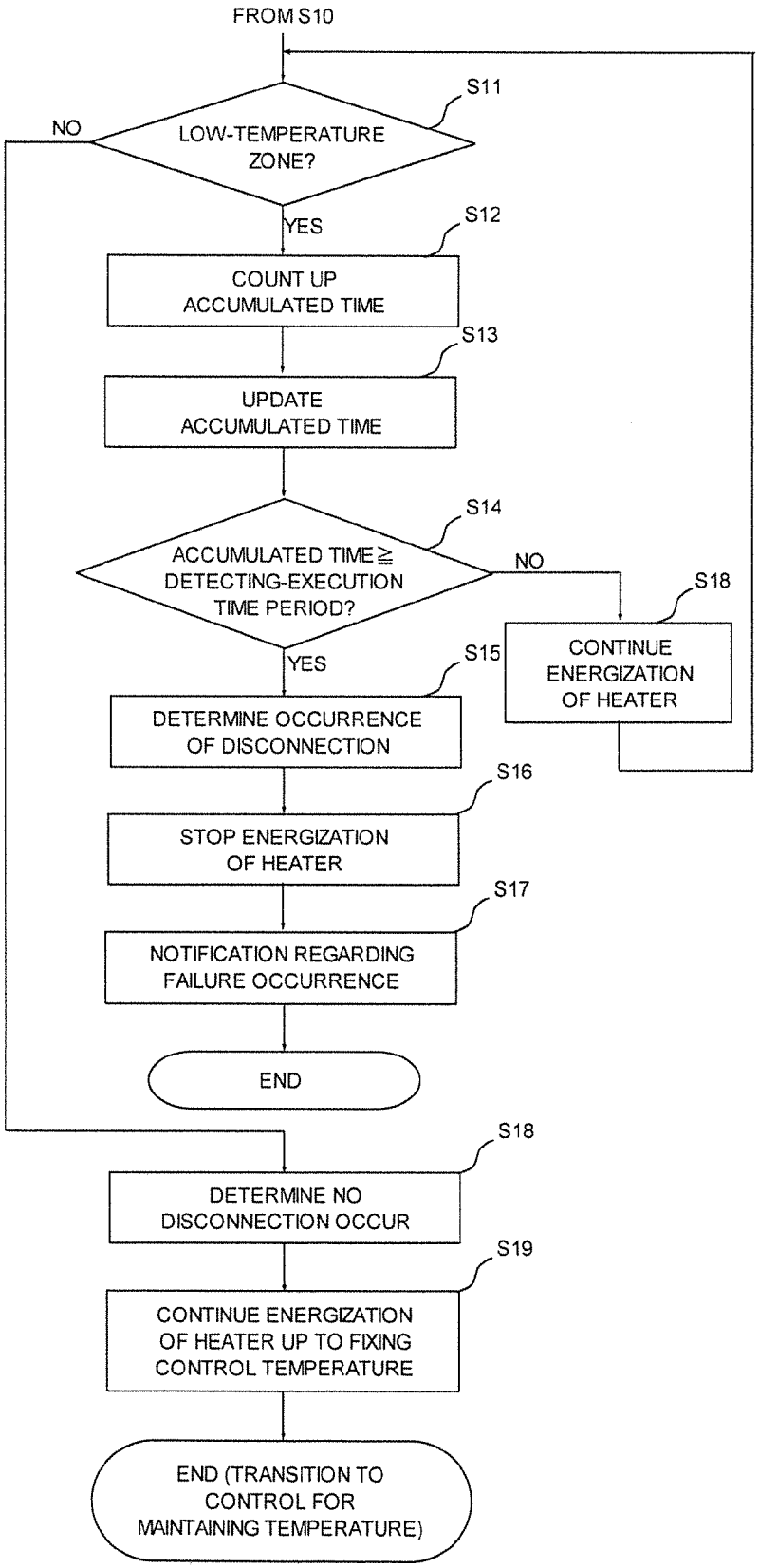
FIG. 8 is a flowchart representing the flow of the process for warm-up in the fixing unit.

Next, based on FIG. 7 and FIG. 8, a flow of a warm-up process at the fixing unit 1 for the printer 100 according to the embodiment will be described. FIG. 7 and FIG. 8 are flowcharts representing the flow of a process for warm-up in the fixing unit 1. A sequence of the processes is divided into FIG. 7 and FIG. 8.

First, the start in FIG. 7 is the time point of turn-on of the printer 100 by the operation of the power supply switch 8 by the user.

After turning on of the printer 100 by the operation with the power supply switch 8, the controller 5 reads a program and data for warm-up of the fixing unit 1 from the storage unit 54 (Step S1). Then, the controller 5 rotates the heating roller 11 and the pressure roller 12 (Step S2).

Then, the controller 5 nonvolatilely stores the first actual time as time, when the printer 100 is turned on by turning on the power supply switch 8, in the backup memory 55 (Step S3). The newly stored first actual time data may be overwritten on the previously stored first actual time data.

When the power supply switch 8 is turned off and on while the heating roller 11 is warm, the heating roller 11 may have already been warm enough. Therefore, the controller 5 checks whether the temperature of the heating roller 11 has reached the fixing control temperature or not based on the output from the temperature sensor 7 (Step S4).

If detection that the temperature of the heating roller 11 reaches the fixing control temperature cannot be made (No in Step S4), the controller 5 checks whether the temperature of the heating roller 11 detected based on the output from the temperature sensor 7 is a temperature in the predetermined low-temperature zone or not (Step S5).

If the temperature detected is a temperature in the low-temperature zone (Yes in Step S5), the controller 5 obtains elapsed time from the previous second actual time stored in the backup memory 55 to the first actual time (Step S6). Then, the controller 5 checks whether the elapsed time exceeds the predetermined stop duration or not (Step S7). In other words, in Step S6 and Step S7, the controller 5 checks whether the accumulated time T1 should be reset or not. With the printer 100 according to the embodiment, the stop duration is set to several ten seconds while the detecting-execution time period is set to approximately several seconds. Accordingly, the stop duration is sufficiently longer than the detecting-execution time period.

If the elapsed time exceeds the stop duration (Yes in Step S7), the heating roller 11 is regarded as cool. Then, the controller 5 resets the accumulated time T1 in the backup memory 55 (Step S8). In other words, the controller 5 updates the accumulated time T1 in the backup memory 55 to zero.

On the other hand, if the temperature detected is not a temperature in the low-temperature zone (No in Step S5), the magnitude of the output voltage of the temperature sensor 7 has changed by the value exceeding a predetermined value than the output voltage value of the temperature sensor 7 during disconnection. The magnitude increases to the extent that cannot be recognized as disconnection. Therefore, in the case of No in Step S5, the controller 5 determines that disconnection does not occur in the temperature sensor 7 (Step S5-2). After Step S5-2, when the elapsed time does not exceed the stop duration (No in Step S7), the controller 5 causes the energizing circuit unit 14 to start the energization of the heater 6 (Step S9) after resetting the accumulated time T1 (Step S8). The controller 5 stores the second actual time when the energization of the heater 6 is started to the backup memory 55 (Step S10). The newly stored data of second actual time may be overwritten on the previously stored second actual time data.

Then, the controller 5 checks whether the detected temperature is a temperature in the low-temperature zone or not based on the output from the temperature sensor 7 (Step S11). If the detected temperature is a temperature in the low-temperature zone (Yes in Step S11), the accumulated time T1 of the energization of the heater 6 is counted up (Step S12). In other words, the controller 5 updates the accumulated time T1 based on time from starting of the energization of the heater 6. In the printer 100 according to the embodiment, the controller 5 counts the accumulated time T1 in increments of several tens to 100 ms. Further, the controller 5 newly stores the newly counted accumulated time T1 in the backup memory 55. In other words, the controller 5 updates the accumulated time T1 stored in the backup memory 55 to the newly counted accumulated time T1 (Step S13). The data of the newly updated accumulated time T1 may be overwritten on the data of the previously stored accumulated time T1.

Then, the controller 5 checks whether the accumulated time T1 reaches the detecting-execution time period to determine whether disconnection of the temperature sensor 7 occurs or not (Step S14). If the accumulated time T1 reaches the detecting-execution time period (Yes in Step S14), even if the heater 6 is energized to the extent that existence of disconnection can be determined, the temperature detected based on the output from the temperature sensor 7 is found to be a temperature in the low-temperature zone. This suggests that the output value indicating the temperature of the heating roller 11 is not appropriately input from the temperature sensor 7 to the controller 5. Therefore, the controller 5 determines that the disconnection of the temperature sensor 7 has occurred when Step S14 is Yes (Step S15).

Then, the controller 5 causes the energizing circuit unit 14 to stop the energization of the heater 6 (Step S16). Subsequently, the controller 5 displays notification regarding a failure such as disconnection of the temperature sensor 7, necessity of repair, and calling a serviceman, on the display unit 22 of the operation panel 2 (Step S17). Then, this process is terminated.

On the other hand, if the accumulated time T1 does not reach the detecting-execution time period (No in Step S14), the controller 5 causes the energizing circuit unit 14 to continue the energization of the heater 6 (Step S18). Then, the process returns to Step S11.

In Step S11, if the current detected temperature of the heating roller 11 departs from the low-temperature zone and exceeds the low-temperature zone (No in Step S11), the controller 5 detects that the magnitude of the output voltage of the temperature sensor 7 has changed by a value exceeding the predetermined value, compare with the output voltage value of the temperature sensor 7 during disconnection. This means that the disconnection of the temperature sensor 7 has not occurred. Therefore, if the detected temperature exceeds the low-temperature zone, the controller 5 determines that the disconnection of the temperature sensor 7 has not occurred (Step S19). Then, the controller 5 causes the energizing circuit unit 14 to continue the energization of the heater 6 until the temperature of the heating roller 11 becomes the fixing control temperature (Step S20). Then, the controller 5 terminates the process (end). Then, the process is transitioned to a control for maintaining temperature that maintains the temperature of the heating roller 11 at the fixing control temperature.

In Step S4 before the energization of the heater 6 starts, when a state that the temperature of the heating roller 11 reaches the fixing control temperature can be detected (Yes in Step S4), the disconnection of the temperature sensor 7 has not occurred and it is not necessary to energize the heater 6. In this case as well, the controller 5 determines that the disconnection of the temperature sensor 7 has not occurred (Step S21) and terminates the process (end). Then, the process is transitioned to a control for maintaining temperature that maintains the temperature of the heating roller 11 at the fixing control temperature.

Thus, the controller 5 detects the temperature of the heating roller 11 based on the output from the temperature sensor 7 before starting the energization of the heater 6. If the detected temperature exceeds the low-temperature zone, the controller 5 immediately determines that the disconnection of the temperature sensor 7 has not occurred without determining existence of the disconnection of the temperature sensor 7 even if the accumulated time T1 becomes the predetermined detecting-execution time period.

Thus, the image forming apparatus according to the embodiment (printer 100) includes: a fixing unit 1 that includes a heater 6 configured to emit heat by energization and a temperature-detecting unit (temperature sensor 7) configured to detect a temperature of a heated member (heating roller 11) heated by the heater 6 and is configured to fix a toner image onto a paper sheet P by heat from the heater 6; a power supply switch 8 configured to turn on and off a power source for the image forming apparatus; a timer unit 52 configured to count time; a backup memory 55 configured to nonvolatilely store an accumulated time T1, the accumulated time T1 being a total period of time during which the heater 6 is energized for detection of disconnection of the temperature-detecting unit after the power supply switch 8 is turned on; and a controller 5 configured to: recognize temperature of the heated member based on an output from the temperature-detecting unit, control the energization of the heater 6, and start the energization of the heater 6 when the power supply switch 8 is turned on. The controller 5 is configured to determine that a disconnection of the temperature-detecting unit has occurred if the temperature recognized based on the output from the temperature-detecting unit remains in a predetermined low-temperature zone when the accumulated time T1 has become a predetermined detecting-execution time period.

Accordingly, even if the power supply switch 8 of the image forming apparatus (printer 100) is repeatedly turned off and on and therefore the energization of the heater 6 for detection of disconnection is repeated, existence of disconnection is determined when the total energization for detection of disconnection reaches the accumulated time T1 and the heated member (heating roller 11) is warmed enough. Therefore, when the power supply switch 8 is repeatedly turned off and on, existence of disconnection of the temperature sensor 7 can be reliably detected without delaying the start of the energization of the heater 6 as conventionally done. This prevents lengthening time required for warm-up. Thus, even if the power supply switch 8 is repeatedly turned off and on, the warm-up is smoothly completed, allowing quick use of the image forming apparatus.

Even if the power supply switch 8 is repeatedly turned off and on and the temperature detected by the controller 5 at turn-on is low, the total accumulated time of the energization of the heater 6 for detection of disconnection is up to the accumulated time T1. This prevents excessive temperature rise of the fixing unit 1 and a member included in the fixing unit 1 due to the energization of the heater 6 for detection of disconnection. Therefore, even if the user repeatedly turns off and on the power supply switch 8, excessive temperature rise does not occur.

Alternatively, the timer unit 52 counts actual times. The backup memory 55 nonvolatilely stores a first actual time, which is the time in the present at which the power source (power supply switch 8) of the image forming apparatus (printer 100) is turned on, and a second actual time, which is the time at which the energization of the heater 6 for determination that the disconnection of the temperature-detecting unit (temperature sensor 7) starts. The controller 5 obtains time elapsed from the immediately previous second actual time stored in the backup memory 55 to the first actual time before the energization of the heater 6 starts and after the power supply switch 8 is turned on. If the obtained elapsed time exceeds predetermined stop duration, the controller 5 resets the accumulated time T1 in the backup memory 55. This stop duration is longer than the detecting-execution time period. Accordingly, once the temperature of the warmed heated member (heating roller 11) is sufficiently cooled, counting of the accumulated time T1 is started from zero. Accordingly, if the temperature of the fixing unit 1 becomes sufficiently low, detection of disconnection can be performed after the heated member is heated again by the heater 6 to the temperature at which detection of disconnection can be accurately performed. In the re-heating, excessive temperature rise does not occur in the fixing unit 1 and a member in the fixing unit 1.

Alternatively, the controller 5 recognizes the temperature of the heated member (heating roller 11) based on the output from the temperature-detecting unit (temperature sensor 7) before starting the energization of the heater 6. If the recognized temperature is equal to or more than the low-temperature zone, like when the temperature of heated member is equal to or more than the fixing control temperature suitable for fixation, the controller 5 determines that disconnection of the temperature-detecting unit has not occurred. Accordingly, if the power supply switch 8 of the image forming apparatus (printer 100) in use is turned off and on, in association with the turn-on of the power supply switch 8, the controller 5 immediately determines that the temperature-detecting unit is not disconnected. Therefore, existence of disconnection of the temperature-detecting unit can be quickly determined without the energization of the heater 6 for detection of disconnection. The temperature of the heated member already heated is not further increased for detection of disconnection, preventing excessive temperature rise at the fixing unit 1.

Alternatively, since the temperature-detecting unit (temperature sensor 7) includes a thermistor 7*a*, the output voltage value from the temperature-detecting unit during disconnection is closer to its output voltage value when the temperature recognized based on the temperature-detecting unit is in the low-temperature zone than its output voltage value when the recognized temperature is higher than the low-temperature zone (when the temperature is the fixing control temperature or several multiples of the low-temperature zone). Accordingly, even if the temperature sensor 7 with difficulty in determination of existence of disconnection, due to small change in the output value of the temperature-detecting unit in a state that the temperature of the heated member (heating roller 11) is in a low-temperature zone, is employed, whether disconnection occurs or not can be accurately determined.

Alternatively, when the image forming apparatus (printer 100) is turned on using the power supply switch 8, the controller 5 starts the energization of the heater 6 at a fixed timing irrespective of amount of time from the power supply switch 8 being turned off until being turned on again. Accordingly, even if time from the power supply switch 8 being turned off to being turned on again is equal to or less than the predetermined time, a process to delay the start of the energization of the heater 6 is not performed as conventionally done. Therefore, when the start of the energization of the heater 6 is enabled after turn-on of the power supply switch 8, the energization of the heater 6 can be immediately started, thereby realizing minimization of the warm-up time.

Alternatively, the image forming apparatus (printer 100) according to the embodiment includes a notification unit (operation panel 2) for giving notice of status of the image forming apparatus. When the controller 5 has determined that the disconnection of the temperature-detecting unit (temperature sensor 7) has occurred, the controller 5 causes the notification unit to give notice that disconnection of the temperature-detecting unit has occurred. This allows notifying the user of information on a failure and a need for repair due to existence of disconnection.

Embodiments of the disclosure are described above. It will be appreciated that the disclosure will not be limited to the embodiments described above, but various modifications are possible without departing from the gist of the disclosure.

The embodiments of this disclosure are applicable to the image forming apparatus including a heater and a temperature sensor for fixation of a toner image.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

a fixing unit that includes a heater configured to emit heat by energization, a heated member to be heated by the heater, and a temperature-detecting unit configured to detect a temperature of the heated member and is configured to fix a toner image to a recording medium by heat from the heater;

a power supply switch configured to turn on and off a power source for the image forming apparatus;

a timer unit configured to count time;

a backup memory configured to nonvolatilely store an accumulated time, the accumulated time being a total period of time during which the heater is energized, for detection of disconnection of power to the temperature-detecting unit after the power supply switch is turned on; and a controller configured to: recognize temperature of the heated member based on output from the temperature-detecting unit, control the energization of the heater, and start the energization of the heater when the power supply switch is turned on; wherein the controller determines that a disconnection of power to the temperature-detecting unit has occurred if the temperature recognized based on the output from the temperature-detecting unit remains in a predetermined low-temperature zone when the accumulated time has become a predetermined detecting-execution time period;

the timer unit counts actual times;

the backup memory nonvolatilely stores a first actual time, being a present time at which the power supply switch is turned on, and a second actual time, being a time at which energization of the heater for detection of disconnection of power to the temperature-detecting unit is started;

the controller obtains time elapsed from an immediately previous second actual time stored in the backup memory to the first actual time, before starting the energization of the heater and after the power supply switch is turned on, wherein if the obtained elapsed time exceeds a predetermined stop duration, the controller resets the accumulated time in the backup memory; and the stop duration is longer than the detecting-execution time period.

2. The image forming apparatus according to claim 1, wherein the controller recognizes temperature of the heated member based on the output from the temperature-detecting unit before starting the energization of the heater, and wherein if the recognized temperature is equal to or more than the low-temperature zone, the controller determines that disconnection of the temperature-detecting unit has not occurred.

3. The image forming apparatus according to claim 1, wherein:

the temperature-detecting unit includes a thermistor; and the output voltage value from the temperature-detecting unit during disconnection is closer to the output voltage value when the temperature recognized based on the temperature-detecting unit is in the low-temperature zone than the output voltage value when the recognized temperature is higher than the low-temperature zone.

4. The image forming apparatus according to claim 1, wherein the controller starts the energization of the heater at a fixed timing irrespective of amount of time from the power supply switch being turned off until being turned on again when the power supply switch is turned on.

5. The image forming apparatus according to claim 1, further comprising a notification unit configured to give notice of status of the image forming apparatus, wherein:

when the controller has determined that the disconnection of the temperature-detecting unit has occurred, the controller causes the notification unit to give notice that the temperature-detecting unit disconnection has occurred.

* * * * *